US009140043B2

(12) United States Patent
Chang et al.

(10) Patent No.: US 9,140,043 B2
(45) Date of Patent: Sep. 22, 2015

(54) HYDRAULIC HINGE BUFFER ASSEMBLY FOR A DOOR

(71) Applicant: Door & Window Hardware Co., Taichung (TW)

(72) Inventors: Wei-Hung Chang, Taichung (TW); Tung-Hsuan Tsai, Taichung (TW)

(73) Assignee: DOOR & WINDOW HARDWARE CO., Taichung (TW)

( * ) Notice: Subject to any disclaimer, the term of this patent is extended or adjusted under 35 U.S.C. 154(b) by 117 days.

(21) Appl. No.: 13/956,466

(22) Filed: Aug. 1, 2013

(65) Prior Publication Data

US 2015/0033504 A1 Feb. 5, 2015

(51) Int. Cl.

*E05D 5/02* (2006.01)
*E05D 11/10* (2006.01)
*E05F 3/20* (2006.01)

(52) U.S. Cl.

CPC ..... *E05D 5/0246* (2013.01); *E05D 11/1064* (2013.01); *E05F 3/20* (2013.01); *E05Y 2201/21* (2013.01); *E05Y 2201/254* (2013.01); *E05Y 2201/256* (2013.01); *E05Y 2201/264* (2013.01); *E05Y 2900/132* (2013.01); *Y10T 16/2771* (2015.01); *Y10T 16/534* (2015.01)

(58) Field of Classification Search

CPC ..... E05D 5/0246; E05D 7/086; E05D 11/00; E05D 11/1064; E05F 3/02; E05F 3/10; E05F 3/20; E05F 5/02; E05Y 2201/21; E05Y 2900/132; E05Y 2900/114; E05Y 2201/254; E05Y 2201/256; E05Y 2201/264; Y10S 16/09; Y10T 16/2771; Y10T 16/304; Y10T 16/534; Y10T 16/554; Y10T 16/61; Y10T 16/54

USPC ..... 16/54, 50, 252, 382, 82, 319, DIG. 9; 188/322.5; 49/388

See application file for complete search history.

(56) References Cited

U.S. PATENT DOCUMENTS

| | | | | | |
|---|---|---|---|---|---|
| 5,867,869 | A * | 2/1999 | Garrett et al. | ..... | 16/252 |
| 6,070,294 | A * | 6/2000 | Perkins et al. | ..... | 16/252 |
| 6,481,055 | B2 * | 11/2002 | Cheng | ..... | 16/252 |
| 6,560,821 | B2 * | 5/2003 | Miller et al. | ..... | 16/252 |
| 6,704,966 | B1 * | 3/2004 | Kao | ..... | 16/252 |
| 6,766,561 | B1 * | 7/2004 | Cheng | ..... | 16/235 |
| 7,010,832 | B2 * | 3/2006 | Chen | ..... | 16/252 |
| 7,114,292 | B2 * | 10/2006 | Chiang | ..... | 49/388 |
| 7,188,390 | B2 * | 3/2007 | Cheng | ..... | 16/252 |
| 7,900,319 | B2 * | 3/2011 | Bacchetti | ..... | 16/252 |
| 8,528,169 | B1 * | 9/2013 | Yu | ..... | 16/51 |
| 8,539,643 | B2 * | 9/2013 | Hung | ..... | 16/252 |
| 8,572,807 | B2 * | 11/2013 | Walhorn et al. | ..... | 16/252 |
| 8,578,556 | B1 * | 11/2013 | Yu | ..... | 16/53 |
| 8,720,005 | B2 * | 5/2014 | Cheng | ..... | 16/54 |
| 8,863,356 | B2 * | 10/2014 | Bacchetti | ..... | 16/54 |
| 2012/0216370 | A1 * | 8/2012 | Chow | ..... | 16/54 |

* cited by examiner

*Primary Examiner* — William Miller

(74) *Attorney, Agent, or Firm* — Muncy, Geissler, Olds & Lowe, P.C.

(57) ABSTRACT

A hydraulic hinge buffer assembly for a door has a fastening device, a buffering device and a clamping device. The fastening device has a holding mount and a pivot block. The buffering device is mounted in the fastening device and has a pivot pin and a piston element. The pivot pin has an abutting face and at least one holding hook. The piston element is mounted between the holding mount and the pivot pin and has a pushing piston. The pushing piston has a pressing face selectively abutting the abutting face and at least one engaging hook axially formed on and protruding from the pressing face and engaging with the at least one holding hook. The clamping device is connected to the buffering device to rotate relative to the fastening device and has two clamping panels.

20 Claims, 13 Drawing Sheets

HYDRAULIC HINGE BUFFER ASSEMBLY FOR A DOOR

BACKGROUND OF THE INVENTION

1. Field of the Invention

The present invention relates to a hydraulic hinge buffer assembly for a door, and more particularly relates to a hydraulic hinge buffer assembly that can prevent the door from closing quickly without a buffering effect due to a rotating inertia or an external force.

2. Description of Related Art

A conventional hydraulic hinge buffer assembly for a door is used to move the door returning to the original position back in a closed state when an external force is applied to the door. The conventional hydraulic hinge buffer assembly has a holding mount, a clamping device and a buffering device. The holding mount is securely mounted on a wall and has a front side and a pivot block. The front side of the holding mount is opposite to the wall. The pivot block is mounted on the front side of the holding mount and has a rear side, a top face, a bottom face, a chamber and a driving recess. The rear side of the pivot block is mounted on and abuts the front side of the holding mount. The chamber is longitudinally formed through the top face and the bottom face of the pivot block. The driving recess is transversally formed through the rear side of the pivot block and communicates with the chamber.

The clamping device is rotatably connected to the holding mount, and is used to clamp a door and has two clamping panels clamped on the door beside the pivot block. The buffering device is mounted in the holding mount and has a pivot pin and a piston element. The pivot pin is rotatably mounted in the chamber of the pivot block and has two ends respectively extending out of the top face and the bottom face of the pivot block and connected to the clamping panels. When the clamping panels are rotated relative to the holding mount, the pivot pin is rotated with the clamping panels relative to the pivot block. In addition, the pivot pin has a middle and an abutting face. The abutting face is flat, is formed in the middle of the pivot pin such that the cross section of the pivot pin is semi-circular at the middle of the pivot pin and faces the driving recess. The piston element is movably mounted in the driving recess, abuts against the pivot pin and has a pushing piston contacting the abutting face of the pivot pin. The piston element can push the pivot pin to rotate relative to the pivot block after being compressed and is driven by a hydraulic-buffering mechanism.

In use, when a user opens the door mounted with the conventional hydraulic hinge buffer assembly, the pivot pin is rotated relative to the pivot block with the clamping panels. The abutting face of the pivot pin separates from the pushing piston of the piston element, and the edge of the pivot pin that is adjacent to the abutting face may abut against and compress the pushing piston of the piston element. When the user releases the door, the compressed piston element will push the pivot pin to rotate to enable the clamping panels to move with the pivot pin. Then, the door that is clamped with the clamping panels can be rotated to the original position back in a closed state by the conventional hydraulic hinge buffer assembly. In addition, the weight and the rotating speed of the door during a closing process will generate a rotating inertia to the conventional hydraulic hinge buffer assembly.

However, if the rotating speed of the pivot pin is quicker than the pushing speed of the pushing piston due to the rotating inertia or an external force, the pivot pin will be rotated with the door and the edge of the pivot pin that is adjacent to the abutting face will separate from the pushing piston. Since the pushing piston of the piston element is driven by the hydraulic-buffering mechanism, the pushing piston cannot provide a buffering effect to the pivot pin and cannot immediately abut against the pivot pin to limit the rotation of the pivot pin, such that no buffering effect is provided to the door via the piston element and the pivot pin during the closing process. Afterwards the door is returned to the original position back in a closed state by the rotation of the pivot pin, the pushing piston of the piston element slowly approaches the pivot pin and abuts against the abutting face of the pivot pin by the hydraulic-buffering mechanism. Therefore, the piston element cannot provide a buffering effect to the door via the pivot pin until the pushing piston abuts against the pivot pin. In other words, the conventional hydraulic hinge buffer assembly cannot provide a buffering effect to the door when the rotating inertia or an external force is applied to the door in an open state.

As a result, when the door in an open state is rotated to the original position by a user, by a pressure force of an indoor air conditioner or by an outdoor wind force to form a rotating inertia, the rotating inertia enables the door to rotate to the original position, and during the closing process, the pushing piston of the piston element of the conventional hydraulic hinge buffer assembly cannot immediately abut and restrict the pivot pin to provide a buffering effect to the door. As such, the conventional hydraulic hinge buffer assembly cannot provide a buffering effect to the door during the above-mentioned closing process and the door may close quickly without a buffering effect.

To overcome the shortcomings, the present invention provides a hydraulic hinge buffer assembly for a door to mitigate the aforementioned problems.

SUMMARY OF THE INVENTION

The main objective of the present invention is to provide a hydraulic hinge buffer assembly for a door that can prevent the door from closing quickly without a buffering effect due to a rotating inertia or an external force.

The hydraulic hinge buffer assembly for a door in accordance with the present invention has a fastening device, a buffering device and a clamping device. The fastening device has a holding mount and a pivot block. The buffering device is mounted in the fastening device and has a pivot pin and a piston element. The pivot pin has an abutting face and at least one holding hook. The piston element is mounted between the holding mount and the pivot pin and has a pushing piston. The pushing piston has a pressing face selectively abutting the abutting face and at least one engaging hook axially formed on and protruding from the pressing face and engaging with the at least one holding hook. The clamping device is connected to the buffering device to rotate relative to the fastening device and has two clamping panels.

Other objectives, advantages and novel features of the invention will become more apparent from the following detailed description when taken in conjunction with the accompanying drawings.

DETAILED DESCRIPTION OF PREFERRED EMBODIMENT

Figure 1:
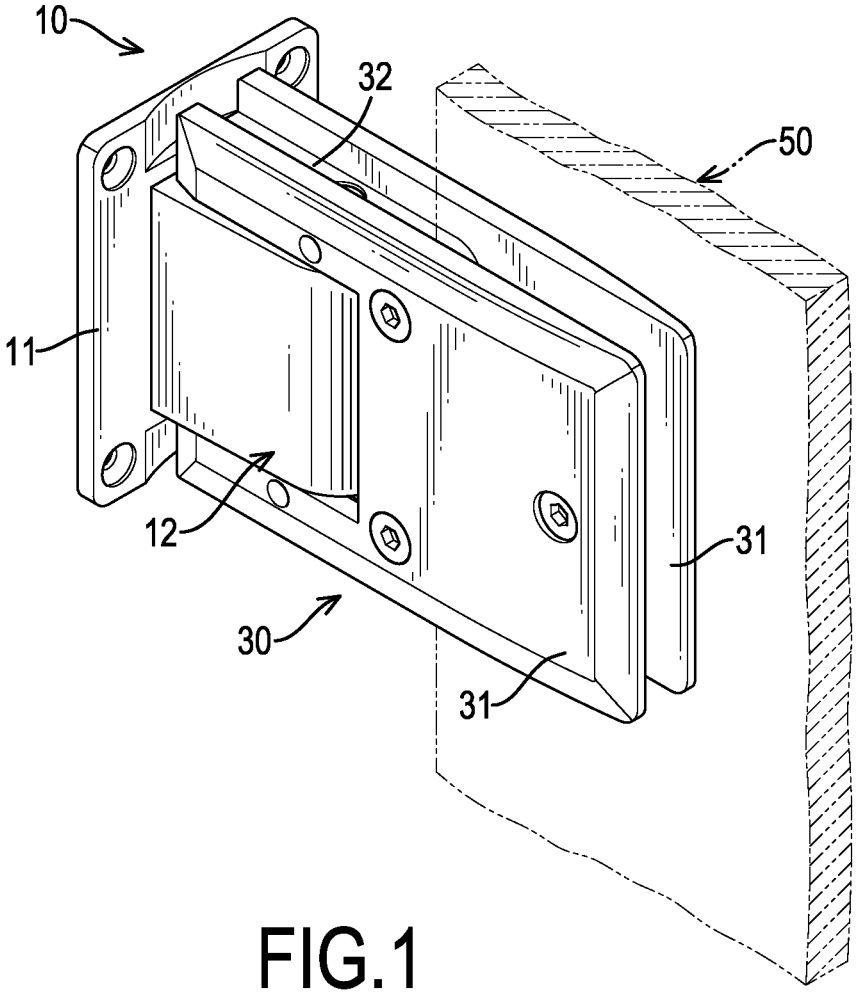
FIG. 1 is an exploded perspective view of a first embodiment of a hydraulic hinge buffer assembly in accordance with the present invention, assembled on a one-directional door.

With reference to FIGS. 1 to 4, a first embodiment of a hydraulic hinge buffer assembly for a door 50 (a one-directional door) in accordance with the present invention comprises a fastening device 10, a buffering device 20 and a clamping device 30.

The fastening device 10 is securely mounted on a wall or a door frame and has a holding mount 11 and a pivot block 12. The holding mount 11 has a front side and a rear side, wherein the rear side is mounted on the wall or the door frame. The pivot block 12 is detachably connected to the front side of the holding mount 11 and has a rear side, a front side, a top face, a bottom face, a chamber 121 and a driving recess 122. The rear side of the pivot block 12 abuts the front side of the holding mount 11. The chamber 121 is longitudinally formed through the top face and the bottom face of the pivot block 12 near the front side of the pivot block 12. The driving recess 122 is transversally formed through the rear side of the pivot block 12 and communicates with the chamber 121.

Figure 3:
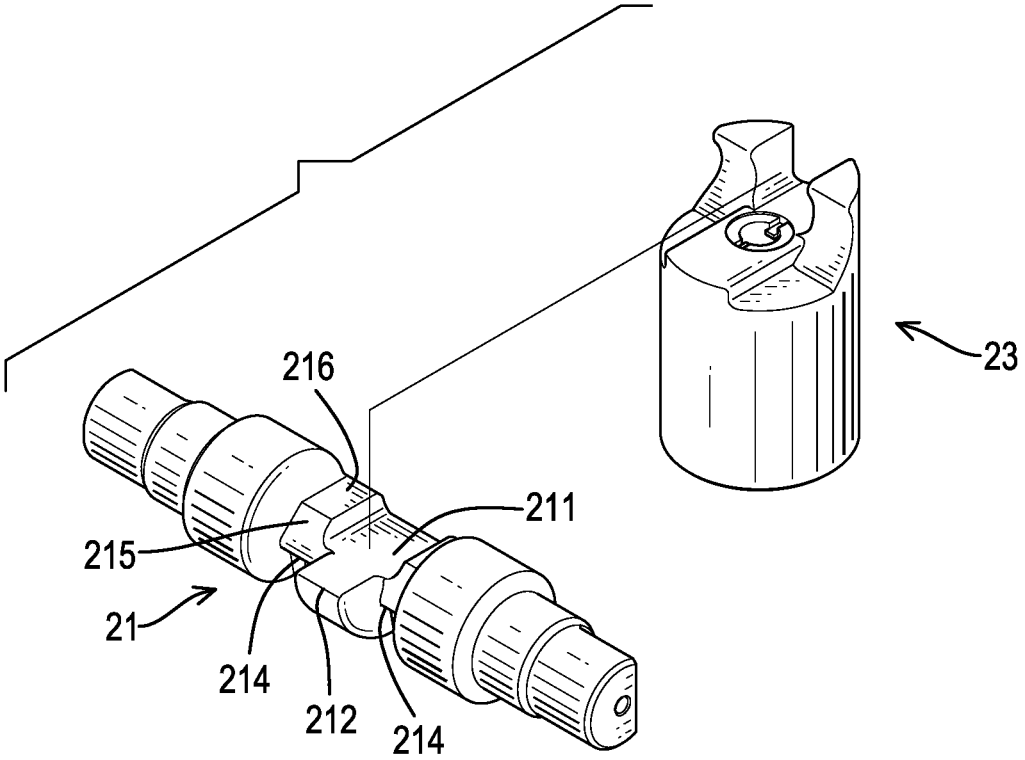
FIG. 3 is an enlarged and exploded perspective view of a buffering device of the hydraulic hinge buffer assembly in FIG. 1.

The buffering device 20 is mounted in the fastening device 10 and has a pivot pin 21 and a piston element 22. The pivot pin 21 is rotatably mounted in the chamber 121 of the pivot block 12 and has an upper end, a lower end, a middle, an abutting face 211, two circular surfaces 212, at least one holding hook 213 and two connecting planes 217. The upper end and the lower end of the pivot pin 21 respectively extend out of the top face and the bottom face of the pivot block 12. The abutting face 211 is formed in the middle of the pivot pin 21 such that the cross section of the middle of the pivot pin 21 is semi-circular and has two edges. Preferably, with reference to FIG. 5, a height of the abutting face 211 is higher than a centerline of the pivot pin 21 to increase the structural strength of the pivot pin 21. With further reference to FIG. 3, the circular surfaces 212 are respectively formed on the edges of the abutting face 211 to reinforce the strength of the abutting face 211 against wearing and tearing.

The at least one holding hook 213 is formed on and protrudes from the pivot pin 21 adjacent to the abutting face 211. Preferably, with reference to FIGS. 3 and 6, the pivot pin 21 has two holding hooks 213 formed on and protruding from the pivot pin 21 beside the abutting face 211, and each holding hook 213 has a curved end. The curved ends of the holding hooks 213 protrude and extend in the same direction as shown in FIG. 3. Preferably, with reference to FIGS. 8 and 11, for a two-directional door 50, the curved ends of the holding hooks 213 protrude and extend in reverse directions. In addition, each holding hook 213 has at least one chamfered face 214, an inclined face 215 and a protruding face 216. The at least one chamfered face 214 is formed on the curved end of the holding hook 213. The inclined face 215 is formed on the holding hook 213 near the at least one chamfered face 214. The protruding face 216 is formed on and protrudes from the holding hook 213 adjacent to the inclined face 215 and is opposite to the at least one chamfered face 214 to increase the structural strength of the pivot pin 21. The connecting planes 217 are respectively formed on the upper end and the lower end of the pivot pin 21 such that the cross sections of the upper end and the lower end of the pivot pin 21 are semi-circular.

Figures 2, 2A:
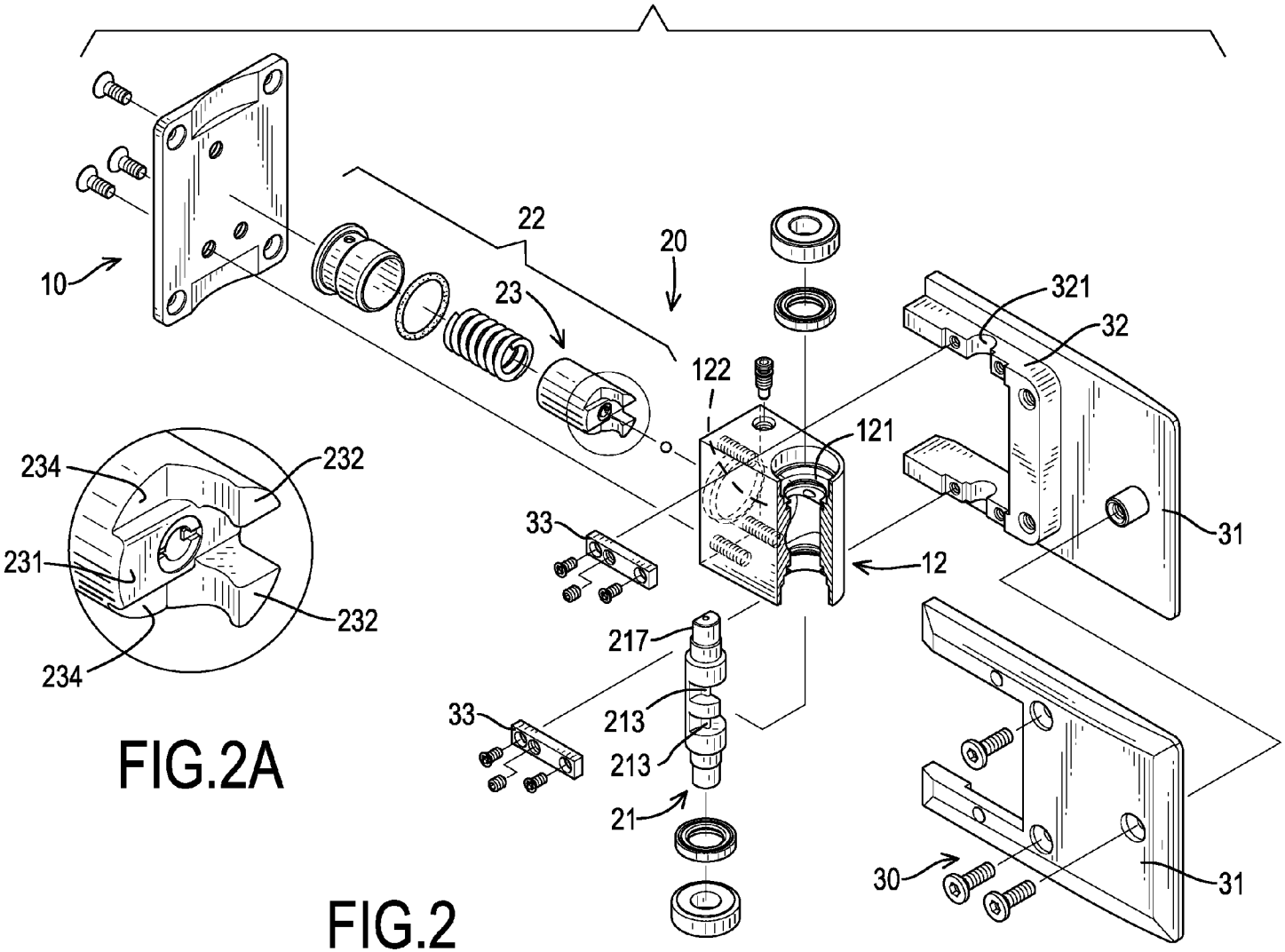
FIG. 2 is an exploded perspective view of the hydraulic hinge buffer assembly in FIG. 1.
FIG. 2A is an enlarged perspective view of the hydraulic hinge buffer assembly in FIG. 2.
Figure 4:
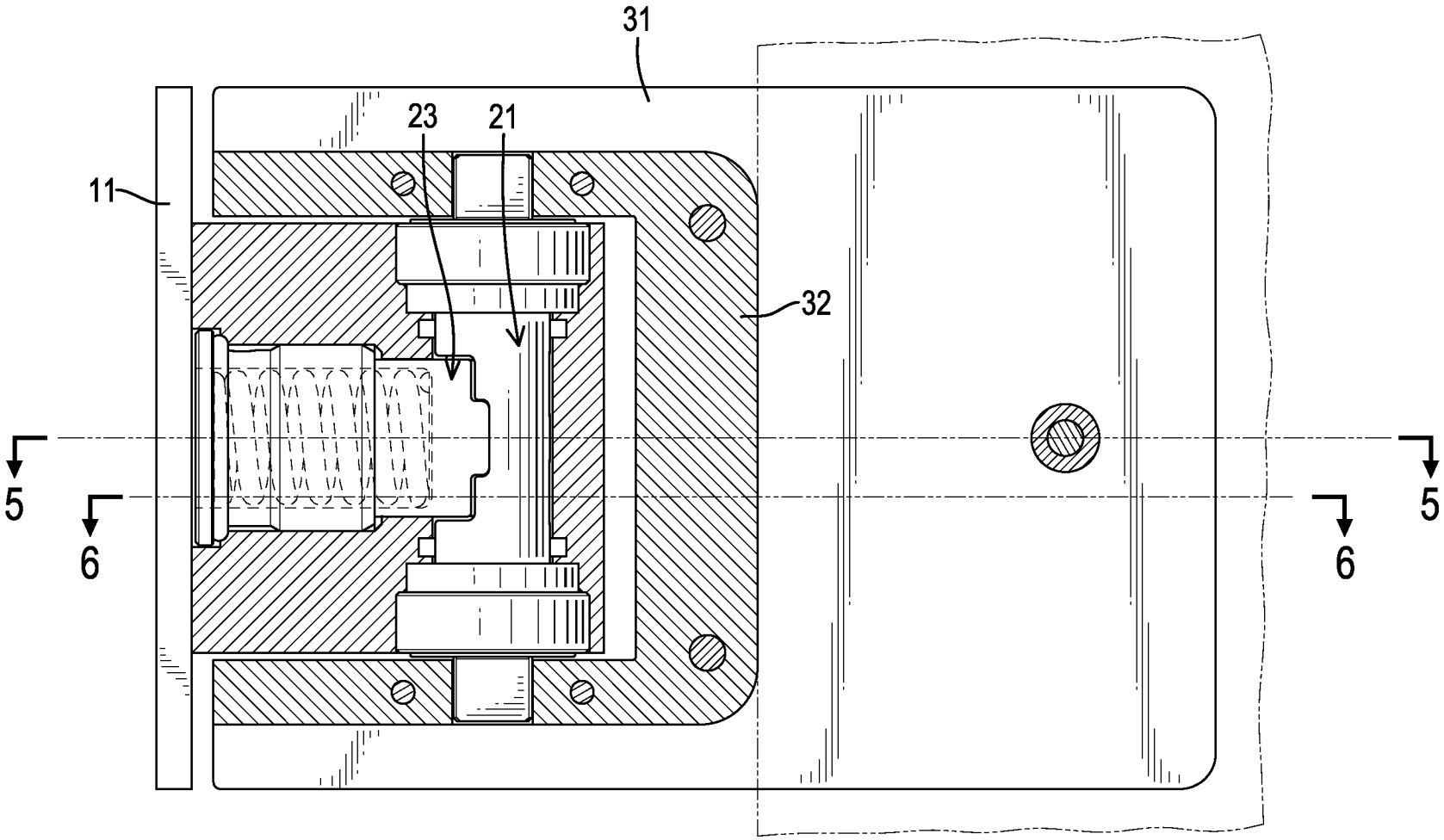
FIG. 4 is an operational side view of the hydraulic hinge buffer assembly in FIG. 1 showing the hydraulic hinge buffer assembly in a closed state.
Figure 5:
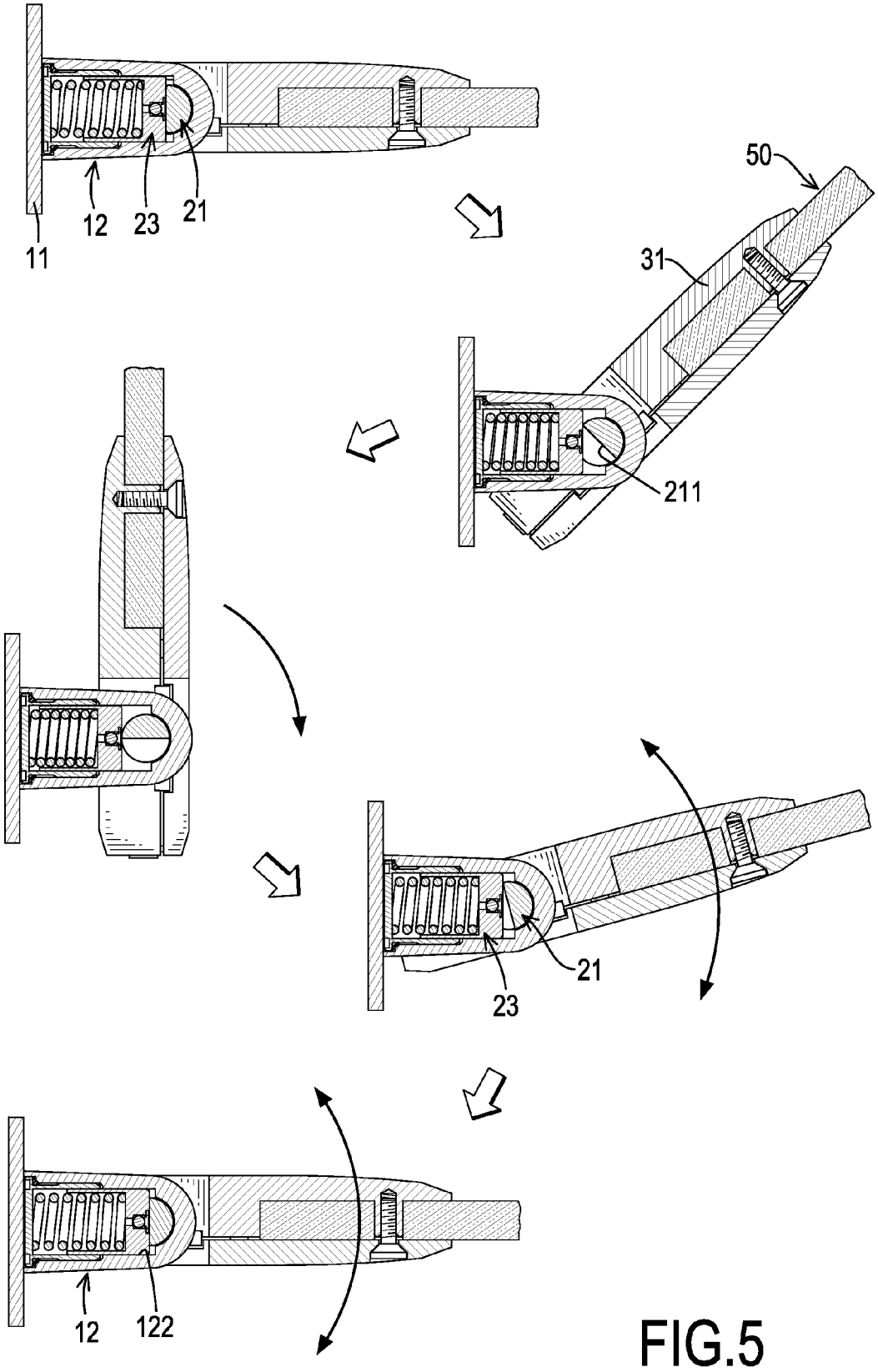
FIG. 5 shows operational cross sectional views in partial section of the hydraulic hinge buffer assembly across line 5-5 in FIG. 4.

With reference to FIGS. 2, 4 and 5, the piston element 22 is mounted in the driving recess 122 of the pivot block 12 between the holding mount 11 and the pivot pin 21, extends in the chamber 121 of the pivot block 12 and abuts the pivot pin 21. The piston element 22 has a space, multiple hydraulic components and a pushing piston 23. The space is formed between the piston element 22 and the driving recess 122 of the pivot block 12 to enable oil to flow in the space. The hydraulic components are mounted in the driving recess 122 of the pivot block 12 and may include a spring, a ring or a cap. The space and the hydraulic components are conventional and the features and the structures of the space and the hydraulic components are not described in detail.

The pushing piston 23 is mounted in the driving recess 122 and extends into the chamber 121 of the pivot block 12, abuts the hydraulic components and engages the pivot pin 21. During a hydraulic operation of the buffering device 20, when the door 50 is rotated, the pivot pin 21 is rotated with the door 50 to compress the piston element 22. Then, the pushing piston 23 can be pushed toward the pivot pin 21 by the compressed hydraulic components of the piston element 22. When the pushing piston 23 pushes the pivot pin 21, the pivot pin 21 will rotate relative to the pivot block 12 to enable the door 50 to rotate to the original position back in a closed state. During the closing process, a hydraulic buffering force of the piston element 22 can be applied to the pushing piston 23. Then, the pushing piston 23 can be pushed slowly and stably to abut and push the pivot pin 21 to rotate relative to the pivot block 12, and this can provide a hydraulic buffering effect to the door 50.

With reference to FIG. 2A, the pushing piston 23 has a front end, a pressing face 231 and at least one engaging hook 232. The pressing face 231 is formed on the front end of the pushing piston 23 and selectively abuts the abutting face 211 of the pivot pin 21. The at least one engaging hook 232 is axially formed on and protrudes from the pressing face 231 and engages with the at least one holding hook 213 of the pivot pin 21. Preferably, with reference to FIGS. 3 and 7, the pushing piston 23 has two engaging hooks 232 axially formed on and protruding from the pressing face 231 of the pushing piston 23, and the engaging hooks 232 each respectively engage with the holding hooks 213 of the pivot pin 21. Each one of the engaging hooks 232 has an engaging end, and the engaging ends of the engaging hooks 232 protrude and extend in the same direction as shown in FIG. 3. In addition, with reference to FIGS. 8 and 11, the pushing piston 23 has two engaging hooks 232, and the engaging ends of the engaging hooks 232 protrude and extend in reverse directions.

Figure 7:
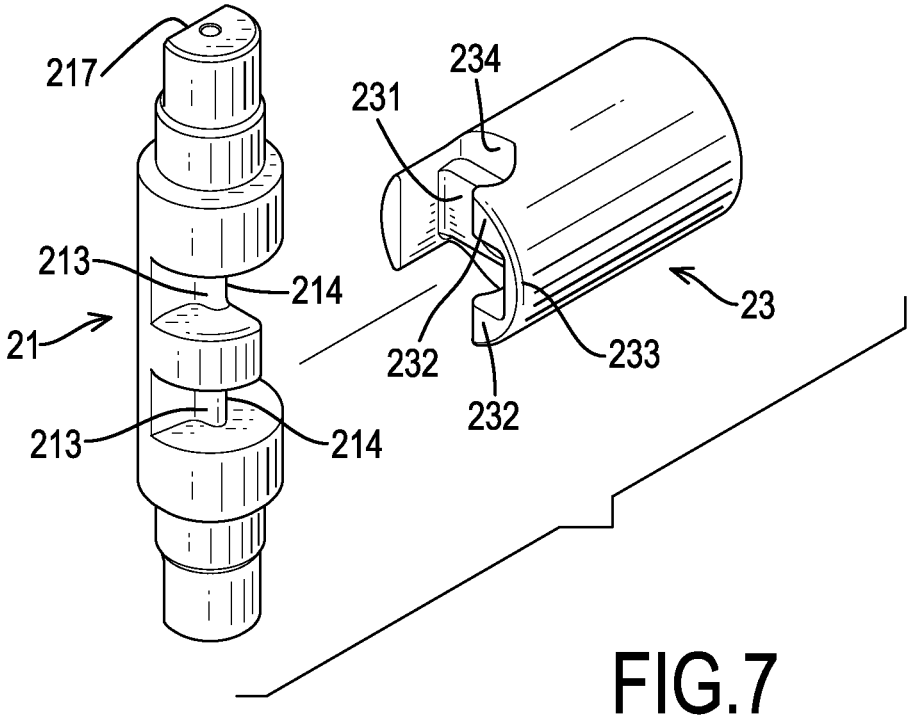
FIG. 7 is an exploded perspective view of a second embodiment of a buffering device of a hydraulic hinge buffer assembly in accordance with the present invention.
Figure 11:
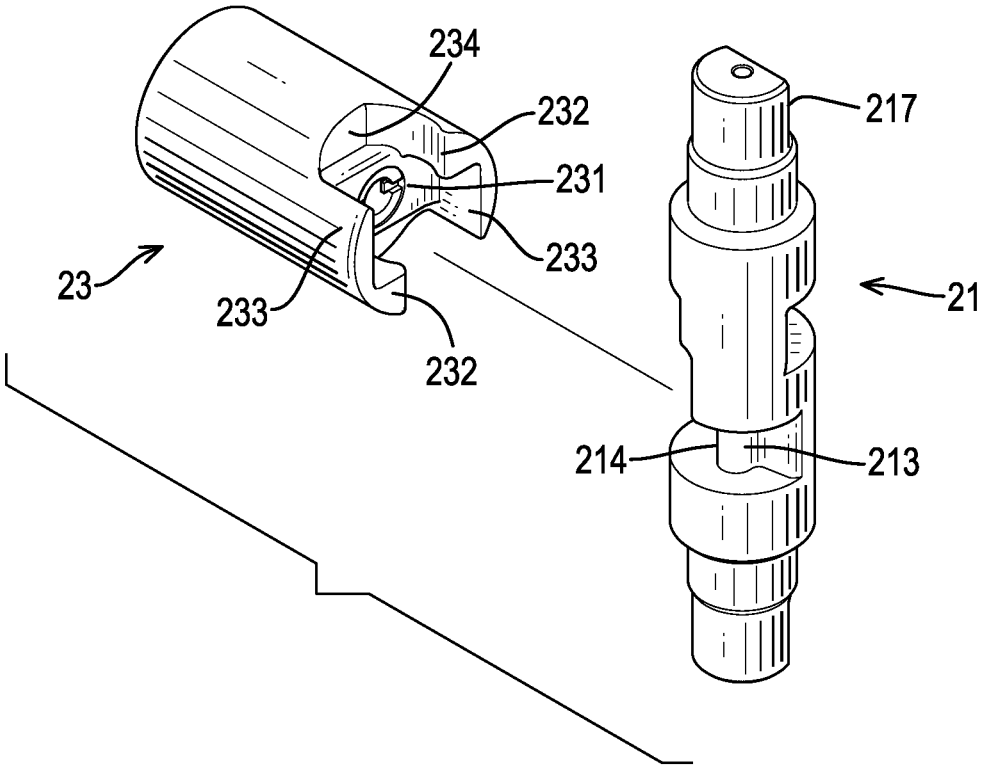
FIG. 11 is an exploded perspective view of a fourth embodiment of a buffering device of a hydraulic hinge buffer assembly in accordance with the present invention.

Furthermore, with reference to FIGS. 7 and 11, the pushing piston 23 has a limiting-reinforcing element 233 formed on and protruding from the pressing face 231 and formed with the at least one engaging hook 232 to increase the structural strength of the at least one engaging hook 232. Additionally, each one of the at least one engaging hook 232 has a concave face 234 formed in the pressing face 231 and the pushing piston 23 and mounted around the protruding face 216 of the at least one holding hook 213 of the pivot pin 21 to enable the pressing face 231 to abut the abutting face 211 of the pivot pin 21 when the door 50 is closed.

Figure 12:
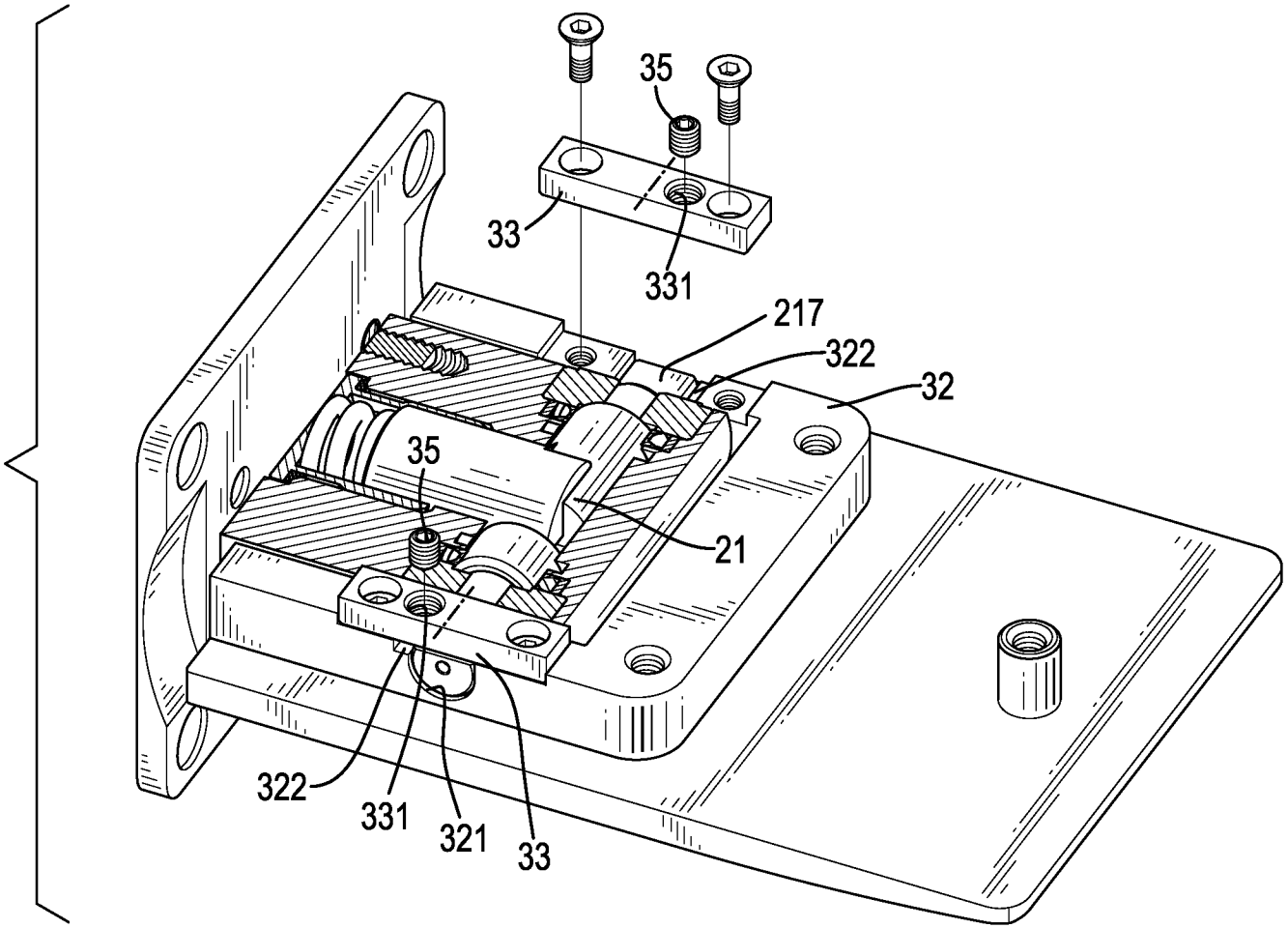
FIG. 12 is another exploded perspective view of the hydraulic hinge buffer assembly in FIG. 11.
Figure 13:
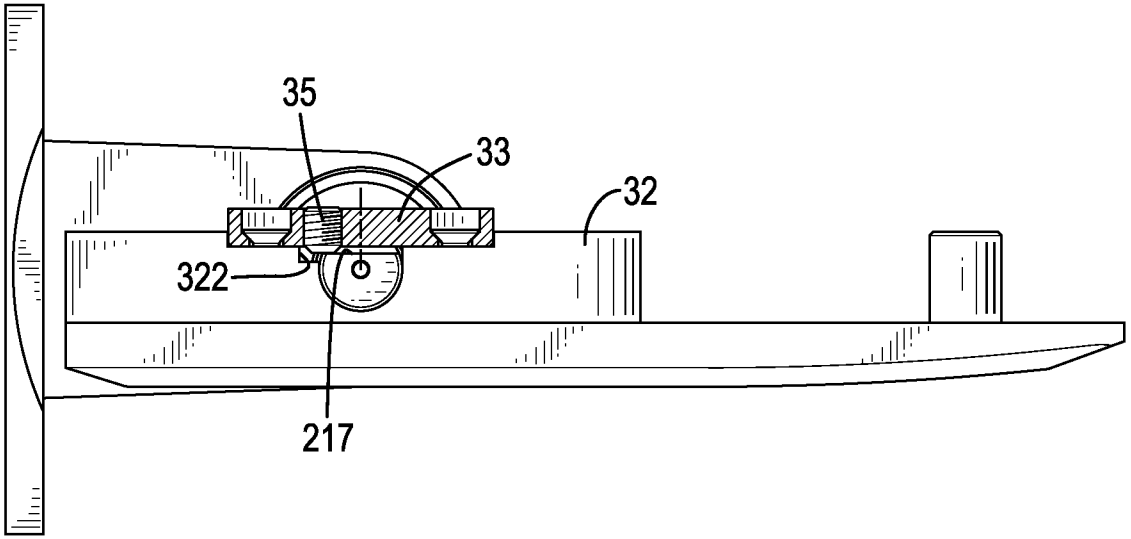
FIG. 13 is a side view in partial section of the hydraulic hinge buffer assembly in FIG. 12.

The clamping device 30 is connected to the buffering device 20 to rotate relative to the fastening device 10 and has two clamping panels 31, a connecting board 32 and two fixing blocks 33. The clamping panels 31 are connected to each other beside the pivot block 12, are connected to the door 50, and each clamping panel 31 has an inner side. With reference to FIGS. 2, 12 and 13, the connecting board 32 is securely mounted on the inner side of one of the clamping panels 31 and has an inner side, two connecting holes 321 and two allowing recesses 322. The connecting holes 321 are formed in the inner side of the connecting board 32 and are respectively mounted around the upper end and the lower end of the pivot pin 21. The allowing recesses 322 are formed in the inner side of the connecting board 32 and are each respectively adjacent to the connecting holes 321. The fixing blocks 33 are securely mounted in the inner side of the connecting board 32. The fixing blocks 33 each respectively face to the connecting planes 217 of the pivot pin 21 with a gap between the fixing block 33 and the connecting plane 217. The gaps between the connecting panels 217 and the fixing blocks 33 enable the pivot pin 21 to rotate with the clamping panels 31 relative to the fastening device 10. Furthermore, each one of the fixing blocks 33 has a centerline, a threaded hole 331 and a screw 35. The threaded hole 331 is formed through the fixing block 33 beside the centerline of the fixing block 33. The screw 35 is mounted in and extends out of the fixing block 33 and abuts a corresponding connecting plane 217 of the pivot pin 21. The user can loosen or fasten the screws 35 to abut and press the connecting planes 217 and this can adjust the rotating direction and angle of the pivot pin 21 relative to the fastening device 10 to assemble the door 50 at a correct position after installation.

With reference to FIGS. 4 and 5, the first embodiment of a hydraulic hinge buffer assembly in accordance with the present invention is connected to a one-directional door 50. When the door 50 is opened by a user, the clamping device 30 is rotated with the door 50 to enable the pivot pin 21 to rotate relative to the pivot block 12 and the piston element 22. Then, the abutting face 211 of the pivot pin 21 will separate from the pressing face 231 of the pushing piston 23 to enable a corresponding one of the circular surfaces 212 to abut the pressing face 231 of the pushing piston 23. When the corresponding circular surface 212 of the pivot pin 21 abuts the pressing face 231 of the pushing piston 23, the pushing piston 23 is moved toward the holding mount 11 to compress the hydraulic components of the piston element 22. When the user releases the door 50, the piston element 22 will provide a hydraulic-buffering pushing force that is opposite to the compressing direction to the pushing piston 23. Then, the pushing piston 23 will push the pivot pin 21 to rotate to the original position and this can enable the door 50 to automatically rotate to the original position back in a closed state.

In addition, without the engagement between the at least one holding hook 213 of the pivot pin 21 and the at least one engaging hook 232 of the pushing piston 23, when an external force is applied to the door 50 that is held in an open state, the corresponding circular surface 212 of the pivot pin 21 that abuts the pressing face 231 of the pushing piston 23 will separate from the pressing face 231 of the pushing piston 23. Then, the abutting face 211 of the pivot pin 21 will approach the pressing face 231 of the pushing piston 23 by the accelerated rotation of the pivot pin 21 to enable the pivot pin 21 to separate away the hydraulic buffering effect of the pushing piston 23, and this enables the door 50 to freely and accelerated rotate to the original position back in a closed state.

Figure 6:
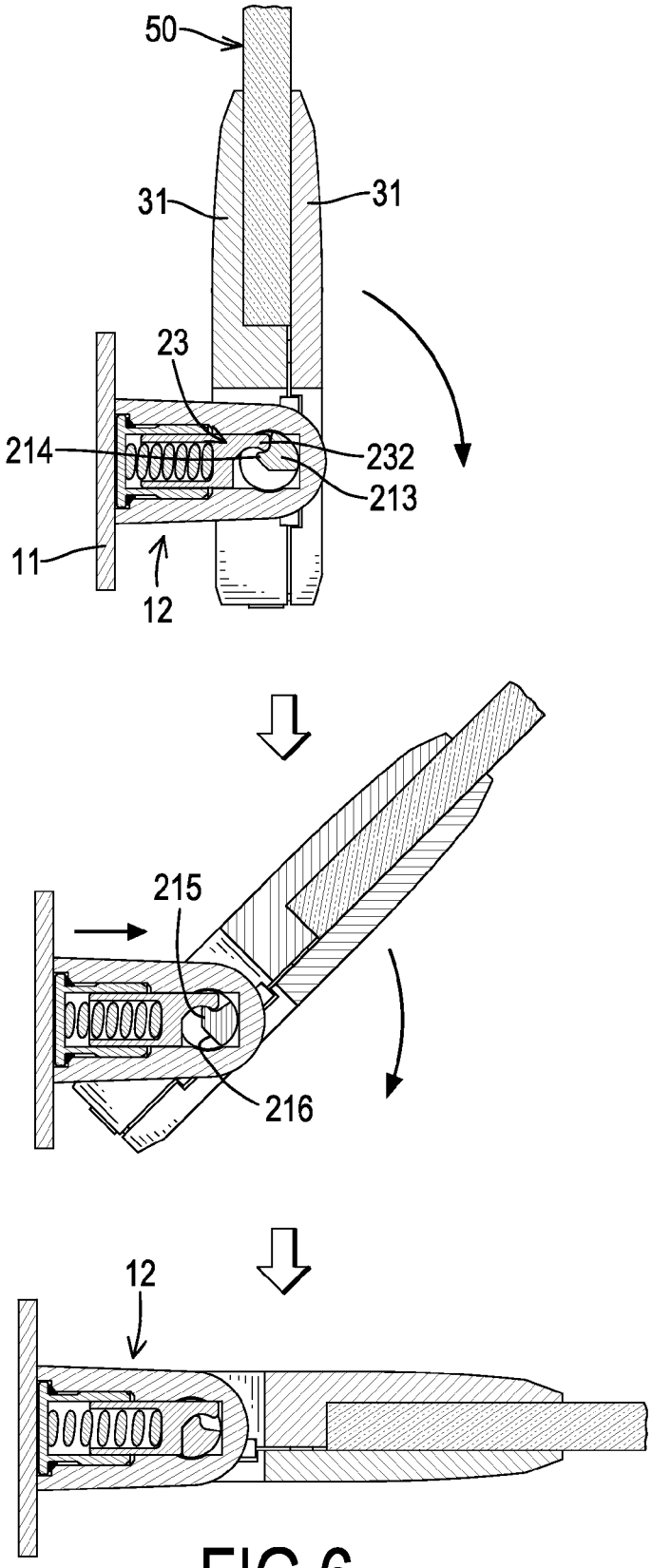
FIG. 6 shows operational cross sectional views in partial section of the hydraulic hinge buffer assembly across line 6-6 in FIG. 4.

However, with reference to FIG. 6, during the closing process of the door 50, the at least one holding hook 213 of the pivot pin 21 engages with the at least one engaging hook 232 of the pushing piston 23. When the door 50 in an open state is rotated to the original position by a user, by a pressure force of an indoor air conditioner or by an outdoor wind force, the pivot pin 21 is rotated with the clamping device 30 and the door 50 relative to the piston element 22. The engagement between the at least one holding hook 213 and the engaging hook 232 can enable the pushing piston 23 to move forwardly with the pivot pin 21 relative to the holding mount 11. Then, during the closing process of the door 50, due to the engagement between the pushing piston 23 and the pivot pin 21, the hydraulic buffering force of the piston element 22 can be applied to the door 50 via the pushing piston 23 and the pivot pin 21.

Figure 8:
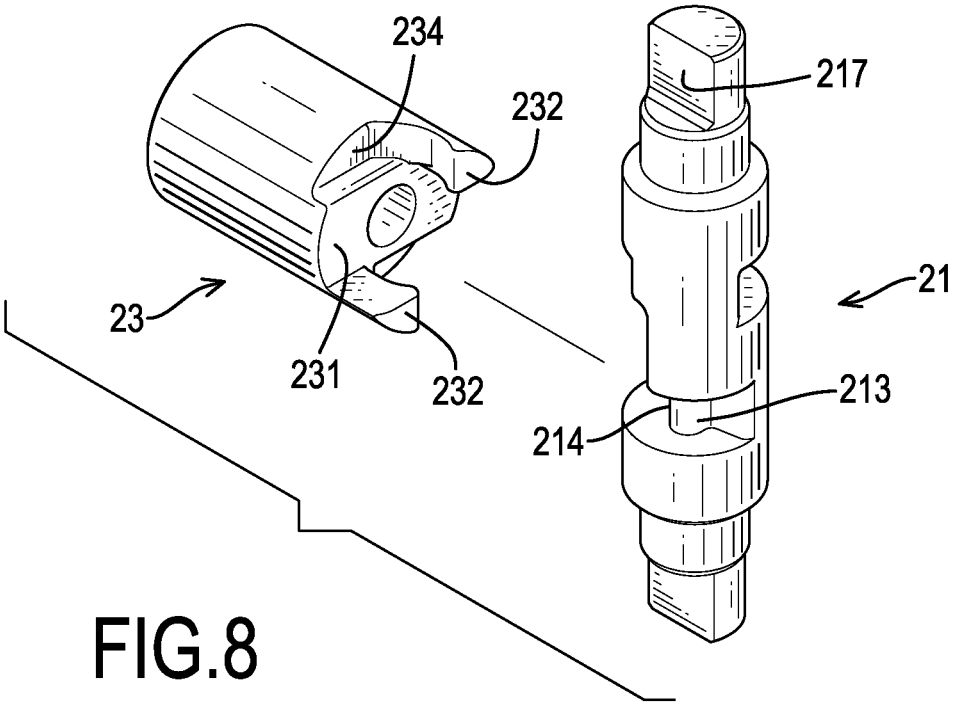
FIG. 8 is an exploded perspective view of a third embodiment of a buffering device of a hydraulic hinge buffer assembly in accordance with the present invention.
Figure 9:
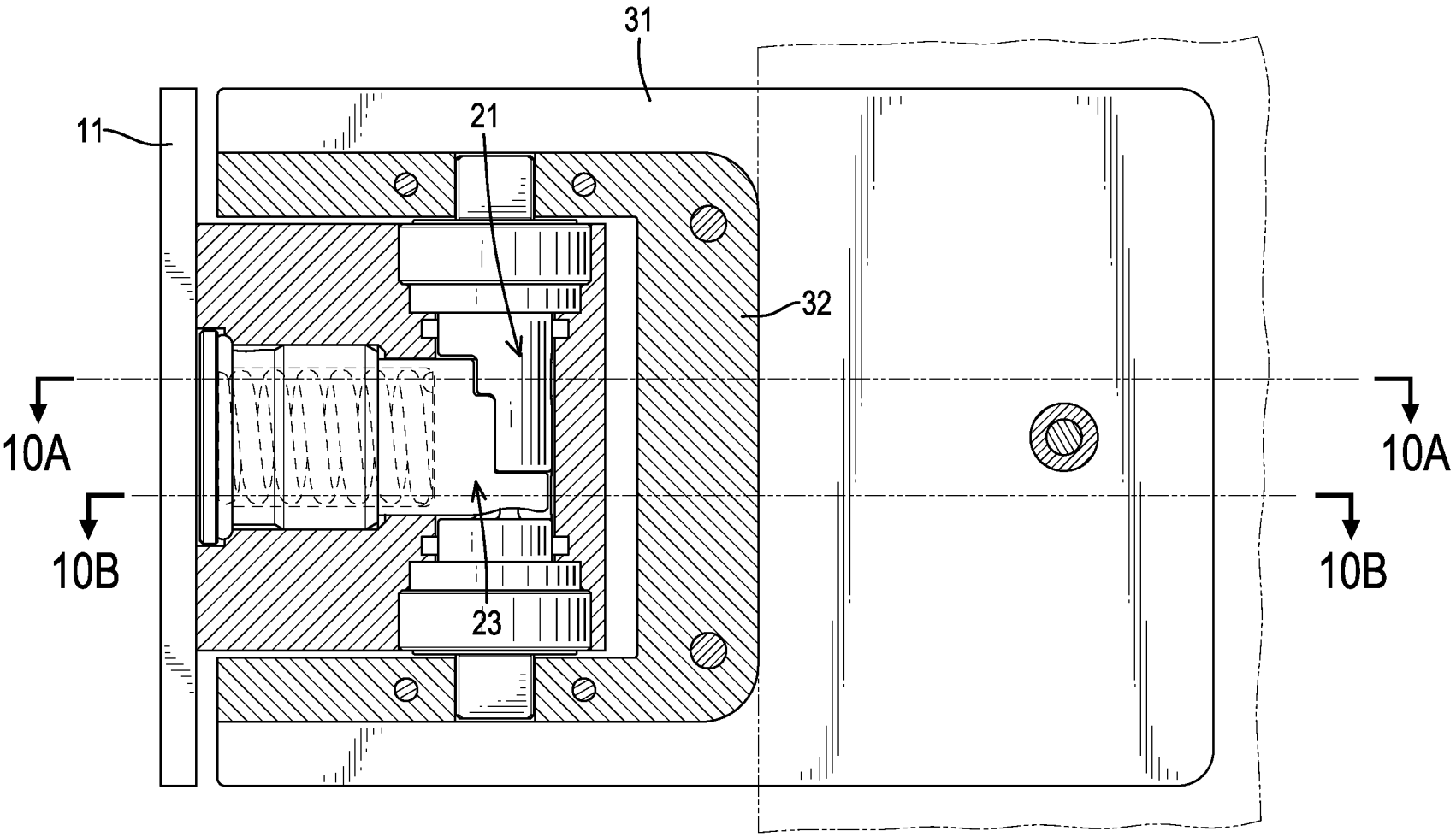
FIG. 9 is an operational side view of the hydraulic hinge buffer assembly in FIG. 8 showing the hydraulic hinge buffer assembly in a closed state for a two-directional door.
Figure 10A:
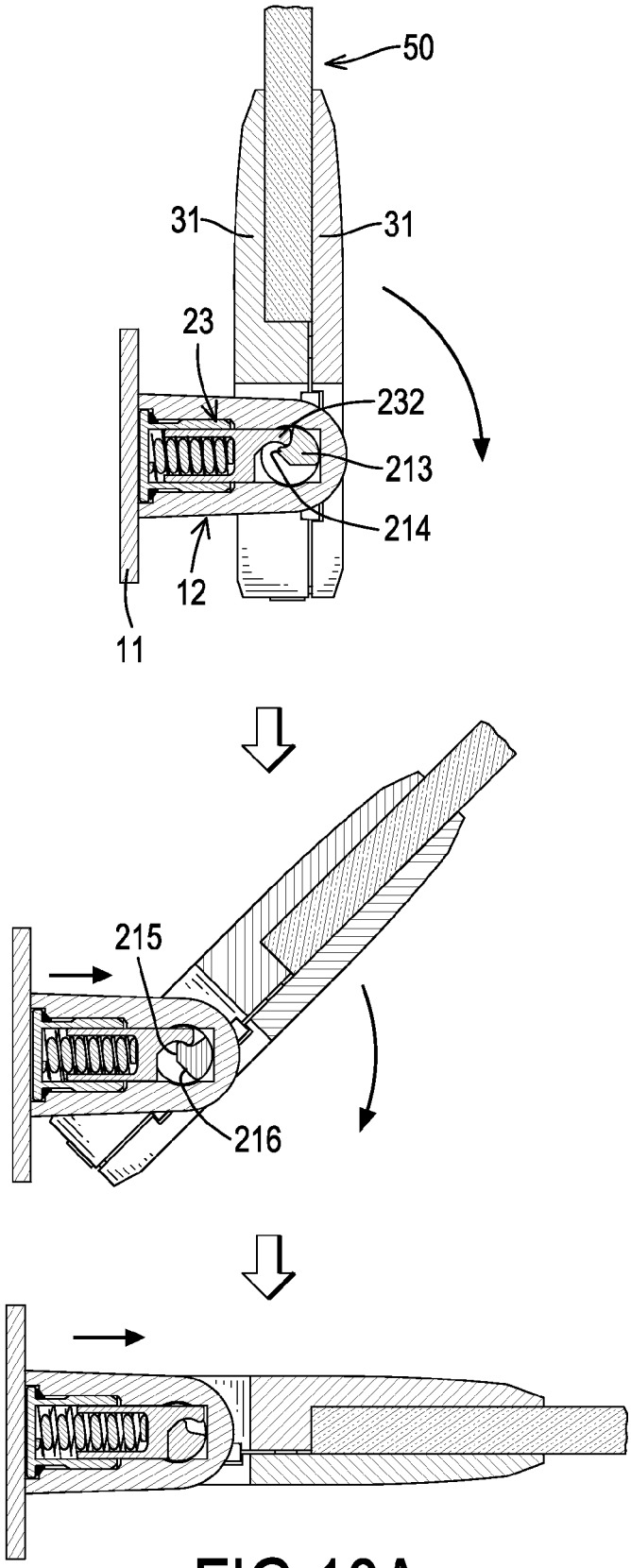
FIG. 10A shows operational cross sectional views in partial section of the hydraulic hinge buffer assembly across line 10A-10A in FIG. 9.
Figure 10B:
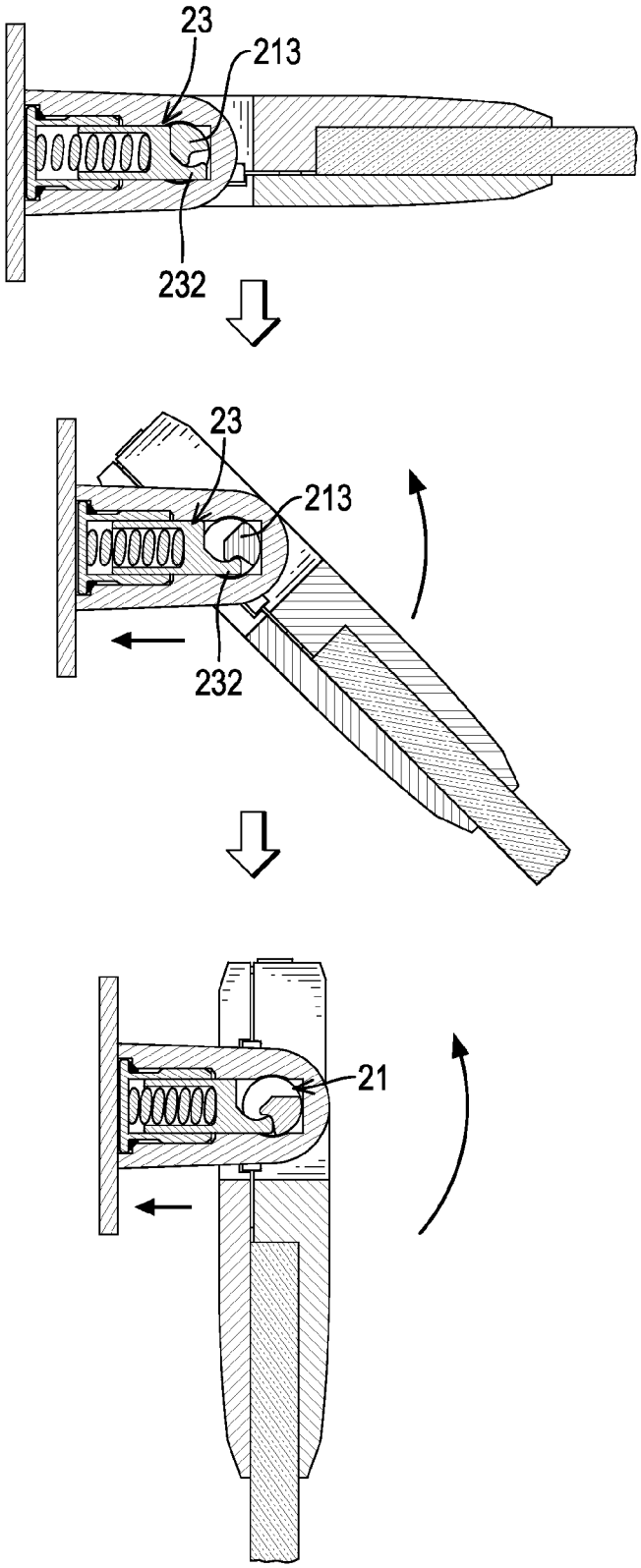
FIG. 10B shows operational cross sectional views in partial section of the hydraulic hinge buffer assembly across line 10B-10B in FIG. 9.

Furthermore, with reference to FIGS. 8 and 9, the third embodiment of a hydraulic hinge buffer assembly in accordance with the present invention can be assembled on a two-directional door 50. In operation, with further reference to FIGS. 10A and 10B, the pivot pin 21 has two holding hooks 213 formed on and protruding from the abutting face 211 in reverse directions and the pushing piston 23 has two engaging hooks 232 each respectively engaging with the holding hooks 213 of the pivot pin 21. Therefore, when the door 50 is being opened in a clockwise or counterclockwise direction, the pushing piston 23 can be moved with the rotation of the pivot pin 21 by one of the engaging hooks 232 engaging with a corresponding holding hook 213 of the pivot pin 21. Then, the hydraulic buffering force of the piston element 22 can be applied to the door 50 via the pushing piston 23 and the pivot pin 21 by the engagement between the holding hooks 213 and the engaging hooks 232.

According to the above-mentioned features, the hydraulic hinge buffer assembly for a door 50 in accordance with the present invention can be assembled on a one-directional door 50 or a two-directional type door 50, the engagement between the holding hooks 213 and the engaging hooks 232 can prevent the pushing piston 23 from separating from the pivot pin 21. Then, when the door 50 in an open state is rotated to the original position by a user, by a pressure force of an indoor air conditioner or by an outdoor wind force, the pushing piston 23 can be moved with the rotation of the pivot pin 21 relative to the holding mount 11. The hydraulic buffering force of the piston element 22 can be applied to the door 50 via the pushing piston 23 and the pivot pin 21 by the engagement between the holding hooks 213 and the engaging hooks 232.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hydraulic hinge buffer assembly for a door comprising:

a fastening device, the fastening device having a holding mount and a pivot block, the holding mount having a front side, the pivot block detachably connected to the front side of the holding mount and having a rear side, a front side, a top face, a bottom face, a chamber longitudinally formed through the top face and the bottom face of the pivot block near the front side of the pivot block, and a driving recess transversally formed through the rear side of the pivot block and communicating with the chamber;

a buffering device, the buffering device mounted in the fastening device and having a pivot pin and a piston element, the pivot pin rotatably mounted in the chamber of the pivot block and having an upper end extending out of the top face of the pivot block, a lower end extending out of the bottom face of the pivot block, a middle, an abutting face formed in the middle of the pivot pin, and at least one holding hook formed on and protruding from the pivot pin adjacent to the abutting face, the piston element mounted in the driving recess of the pivot block between the holding mount and the pivot pin, extending in the chamber of the pivot block, abutting the pivot pin and having a space formed between the piston element and the driving recess of the pivot block to enable oil to flow in the space, and a pushing piston abutting and engaging with the pivot pin, the pushing piston having a front end, a pressing face formed on the front end of the pushing piston and selectively abutting the abutting face of the pivot pin, and at least one engaging hook axially formed on and protruding from the pressing face and engaging with the at least one holding hook of the pivot pin; and a clamping device, the clamping device connected to the buffering device to rotate relative to the fastening device and having two clamping panels connected to each other beside the pivot block to enable the clamping device to rotate with the pivot pin relative to the fastening device, wherein the piston element includes a spring, and when the pivot pin is rotated relative to the pivot block, the pushing piston is moved toward the holding unit to compress the spring of the piston element.

2. The hydraulic hinge buffer assembly as claimed in claim 1, wherein the pivot pin has two holding hooks formed on and protruding from the pivot pin adjacent to the abutting face.

3. The hydraulic hinge buffer assembly as claimed in claim 2, wherein each one of the holding hooks has a curved end, and the curved ends of the holding hooks protrude and extend in the same direction; and the pushing piston has two engaging hooks axially formed on and protruding from the pressing face of the pushing piston, and the engaging hooks each respectively engage with the holding hooks of the pivot pin.

4. The hydraulic hinge buffer assembly as claimed in claim 3, wherein the pushing piston has a limiting-reinforcing element formed on and protruding from the pressing face and formed with the at least one engaging hook to increase the structural strength of the at least one engaging hook.

5. The hydraulic hinge buffer assembly as claimed in claim 4, wherein each holding hook has at least one chamfered face formed on the curved end of the holding hook and an inclined face formed on the holding hook near the at least one chamfered face.

6. The hydraulic hinge buffer assembly as claimed in claim 5, wherein each holding hook has a protruding face formed on and protruding from the holding hook adjacent to the inclined face and being opposite to the at least one chamfered face to increase the structural strength of the pivot pin; and each engaging hook of the pushing piston has a concave face formed in the pressing face and the pushing piston and mounted around the protruding face of a corresponding holding hook of the pivot pin to enable the pressing face to abut the abutting face of the pivot pin.

7. The hydraulic hinge buffer assembly as claimed in claim 6, wherein the pivot pin has two circular surfaces respectively formed on two edges of the abutting face to reinforce the strength of the abutting face against wearing and tearing.

8. The hydraulic hinge buffer assembly as claimed in claim 2, wherein each one of the holding hooks has a curved end, and the curved ends of the holding hooks protrude and extend in reverse directions; and the pushing piston has two engaging hooks axially formed on and protruding from the pressing face of the pushing piston, and the engaging hooks each respectively engage with the holding hooks of the pivot pin.

9. The hydraulic hinge buffer assembly as claimed in claim 8, wherein the pushing piston has a limiting-reinforcing element formed on and protruding from the pressing face and formed with the at least one engaging hook to increase the structural strength of the at least one engaging hook.

10. The hydraulic hinge buffer assembly as claimed in claim 9, wherein each holding hook has at least one chamfered face formed on the curved end of the holding hook and an inclined face formed on the holding hook near the at least one chamfered face.

11. The hydraulic hinge buffer assembly as claimed in claim 10, wherein each holding hook has a protruding face formed on and protruding from the holding hook adjacent to the inclined face and being opposite to the at least one chamfered face to increase the structural strength of the pivot pin; and each engaging hook of the pushing piston has a concave face formed in the pressing face and the pushing piston and mounted around the protruding face of a corresponding holding hook of the pivot pin to enable the pressing face to abut the abutting face of the pivot pin.

12. The hydraulic hinge buffer assembly as claimed in claim 11, wherein the pivot pin has two circular surfaces respectively formed on two edges of the abutting face to reinforce the strength of the abutting face against wearing and tearing.

13. The hydraulic hinge buffer assembly as claimed in claim 1, wherein the pushing piston has a limiting-reinforcing element formed on and protruding from the pressing face and formed with the at least one engaging hook to increase the structural strength of the at least one engaging hook.

14. The hydraulic hinge buffer assembly as claimed in claim 2, wherein the pushing piston has a limiting-reinforcing element formed on and protruding from the pressing face and formed with the at least one engaging hook to increase the structural strength of the at least one engaging hook.

15. The hydraulic hinge buffer assembly as claimed in claim 14, wherein each holding hook has a curved end, and at least one chamfered face formed on the curved end of the holding hook and an inclined face formed on the holding hook near the at least one chamfered face.

16. The hydraulic hinge buffer assembly as claimed in claim 15, wherein each holding hook has a protruding face formed on and protruding from the holding hook adjacent to the inclined face and being opposite to the at least one chamfered face to increase the structural strength of the pivot pin; and each engaging hook of the pushing piston has a concave face formed in the pressing face and the pushing piston and mounted around the protruding face of a corresponding holding hook of the pivot pin to enable the pressing face to abut the abutting face of the pivot pin.

17. The hydraulic hinge buffer assembly as claimed in claim 16, wherein the pivot pin has two circular surfaces respectively formed on two edges of the abutting face to reinforce the strength of the abutting face against wearing and tearing.

18. The hydraulic hinge buffer assembly as claimed in claim 13, wherein each holding hook has a curved end, and at least one chamfered face formed on the curved end of the holding hook and an inclined face formed on the holding hook near the at least one chamfered face.

19. The hydraulic hinge buffer assembly as claimed in claim 18, wherein each holding hook has a protruding face formed on and protruding from the holding hook adjacent to the inclined face and being opposite to the at least one chamfered face to increase the structural strength of the pivot pin; and each engaging hook of the pushing piston has a concave face formed in the pressing face and the pushing piston and mounted around the protruding face of a corresponding holding hook of the pivot pin to enable the pressing face to abut the abutting face of the pivot pin.

20. The hydraulic hinge buffer assembly as claimed in claim 19, wherein the pivot pin has two circular surfaces respectively formed on two edges of the abutting face to reinforce the strength of the abutting face against wearing and tearing.

* * * * *